United States Patent [19]

Forgac et al.

[11] Patent Number: 4,637,464

[45] **Date of Patent: * Jan. 20, 1987**

[54] IN SITU RETORTING OF OIL SHALE WITH PULSED WATER PURGE

[75] Inventors: John M. Forgac, Elmhurst; George R. Hoekstra, Wheaton, both of Ill.

[73] Assignees: Amoco Corporation, Chicago, Ill.; Chevron U.S.A., Inc.

[ * ] Notice: The portion of the term of this patent subsequent to Aug. 6, 2002 has been disclaimed.

[21] Appl. No.: 592,376

[22] Filed: Mar. 22, 1984

[51] Int. Cl.[4] ..... E21B 43/24

[52] U.S. Cl. ..... 166/261; 166/259; 166/266

[58] Field of Search ..... 166/259, 260, 261, 266, 166/299

[56] References Cited

U.S. PATENT DOCUMENTS

| | | | |
|---|---|---|---|
| 4,036,299 | 7/1977 | Cha et al. | 166/259 |
| 4,192,381 | 3/1980 | Cha | 166/259 |
| 4,353,418 | 10/1982 | Hoekstra et al. | 166/261 |
| 4,436,344 | 3/1984 | Forgac et al. | 166/261 |
| 4,444,256 | 4/1984 | Shen | 166/261 |
| 4,457,374 | 7/1984 | Hoekstra et al. | 166/261 |
| 4,532,991 | 8/1985 | Hoekstra et al. | 166/261 |

*Primary Examiner*—George A. Suchfield
*Assistant Examiner*—Bruce M. Kisliuk
*Attorney, Agent, or Firm*—Thomas W. Tolpin; William T. McClain; William H. Magidson

[57] ABSTRACT

Product yield and quality is increased during in situ retorting of oil shale by pulsed combustion in which the flow of feed gas to the flame front is intermittently stopped while continuously retorting the oil shale. In the process, a water purge is injected into the retort between pulses of feed gas to enhance transfer of sensible heat from the combustion zone to the retorting zone and enlarge the separation between the combustion zone and the advancing front of the retorting zone. Retort water produced during retorting can be used as part of the water purge and/or feed gas for process economy and efficiency.

6 Claims, 1 Drawing Figure

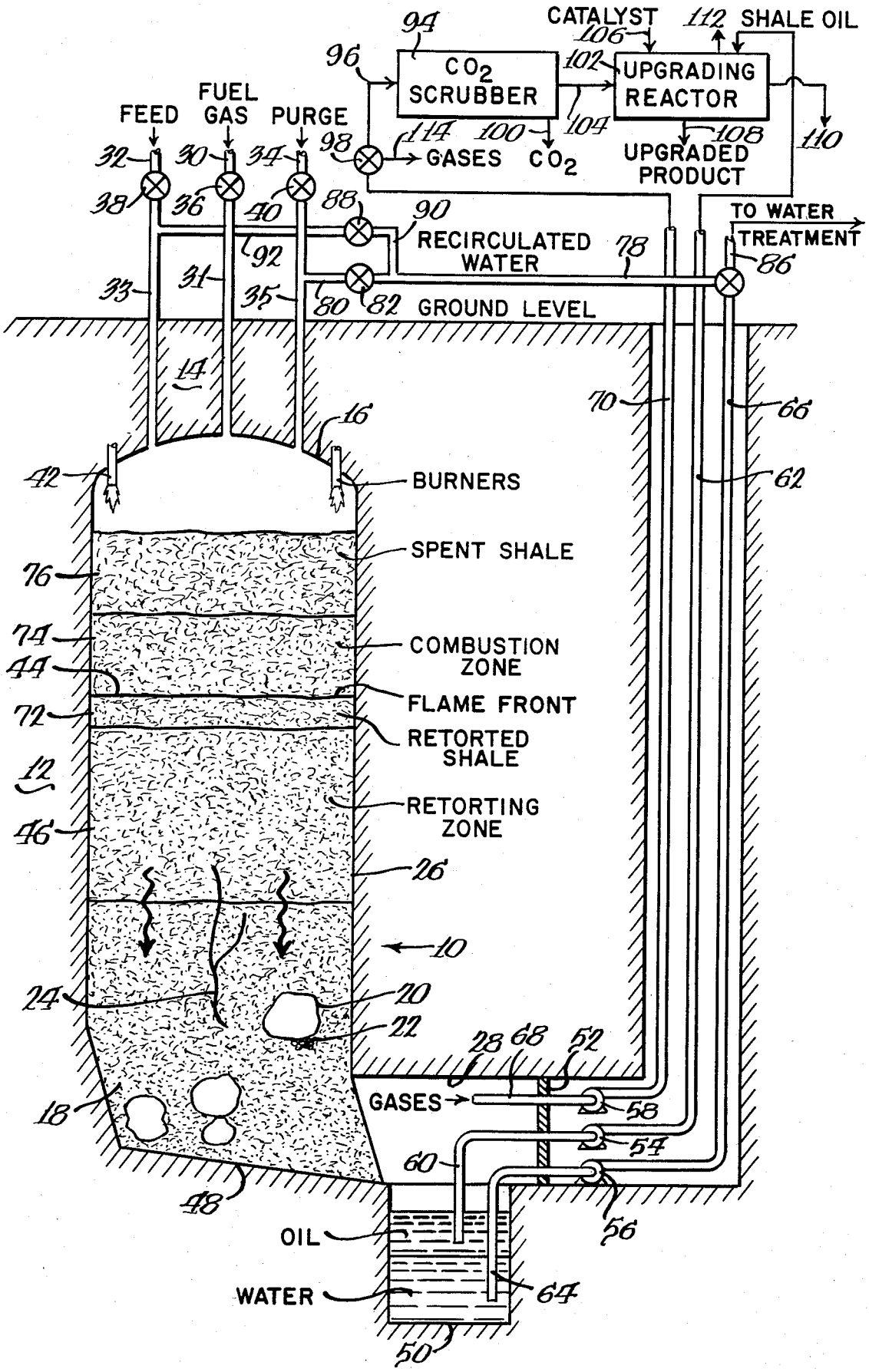
CATALYST
SHALE OIL
$CO_2$ SCRUBBER
UPGRADING REACTOR
FEED
FUEL GAS
PURGE
GASES
$CO_2$
UPGRADED PRODUCT
TO WATER TREATMENT
RECIRCULATED WATER
GROUND LEVEL
BURNERS
SPENT SHALE
COMBUSTION ZONE
FLAME FRONT
RETORTED SHALE
RETORTING ZONE
GASES
OIL
WATER

IN SITU RETORTING OF OIL SHALE WITH PULSED WATER PURGE

BACKGROUND OF THE INVENTION

This invention relates to a process for underground retorting of oil shale.

Researchers have now renewed their efforts to find alternate sources of energy and hydrocarbons in view of past rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts or in underground in situ retorts. In situ retorts require less mining and handling than surface retorts.

In vertical in situ retorts, a flame front moves downward through a rubblized bed containing rich and lean oil shale to liberate shale oil, off gases and condensed water. There are two types of in situ retorts: true in situ retorts and modified in situ retorts. In true in situ retorts, none of the shale is mined, holes are drilled into the formation and the oil shale is explosively rubblized, if necessary, and then retorted. In modified in situ retorts, some of the oil shale is removed by mining to create a cavity which provides extra space for explosively rubblized oil shale. The oil shale which has been removed is conveyed to the surface and retorted above ground.

In order to obtain high thermal efficiency in retorting, carbonate decomposition should be minimized. Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as raw and spent materials handling expense, product yield and process requirements.

While efforts are made to explosively rubblize the oil shale into uniform pieces, in reality the rubblized mass of oil shale contains numerous different sized fragments of oil shale which create vertical, horizontal and irregular channels extending sporadically throughout the bed and along the wall of the retort. As a result, during retorting, hot gases often flow down these channels and bypass large portions of the bed, leaving significant portions of the rubblized shale unretorted.

Different sized oil shale fragments, channeling and irregular packing, and imperfect distribution of oil shale fragments cause other deleterious effects including tilted (nonhorizontal) and irregular flame fronts in close proximity to the retorting zone and fingering, that is, flame front projections which extend downward into the raw oil shale and advance far ahead of other portions of the flame front. Irregular flame fronts and fingering can cause coking, burning, and thermal cracking of the liberated shale oil. Irregular, tilted flame fronts can lead to flame front breakthrough and incomplete retorting. In the case of severe channeling, horizontal pathways may permit oxygen to flow underneath the raw unretorted shale. If this happens, shale oil flowing downward in that zone may burn. It has been estimated that losses from burning in in situ retorting can be as high as 40% of the product shale oil.

Furthermore, during retorting, significant quantities of oil shale retort water are also produced. Oil shale retort water is laden with suspended and dissolved impurities, such as shale oil and oil shale particulates ranging in size from less than 1 micron to 1,000 microns and contain a variety of other contaminants not normally found in natural petroleum (crude oil) refinery waste water, chemical plant waste water or sewage. Oil shale retort water usually contains a much higher concentration of organic matter and other pollutants than other waste waters or sewage causing difficult disposal and purification problems.

The quantity of pollutants in water is often determined by measuring the amount of dissolved oxygen required to biologically decompose the waste organic matter in the polluted water. This measurement, called biochemical oxygen demand (BOD), provides an index of the organic pollution in the water. Many organic contaminants in oil shale retort water are not amenable to conventional biological decomposition. Therefore, tests such as chemical oxygen demand (COD) and total organic carbon (TOC) are employed to more accurately measure the quantity of pollutants in retort water. Chemical oxygen demand measures the amount of chemical oxygen needed to oxidize or burn the organic matter in waste water. Total organic carbon measures the amount of organic carbon in waste water.

Over the years, a variety of methods have been suggested for purifying or otherwise processing oil shale retort water. Such methods have included shale adsorption, in situ recycling, electrolysis, flocculation, bacteria treatment and mineral recovery. Typifying such methods and methods for treating waste water from refineries and chemical and sewage plants are those described in U.S. Pat. Nos. 2,948,677; 3,589,997; 3,663,435; 3,904,518; 4,043,881; 4,066,538; 4,069,148; 4,073,722; 4,124,501; 4,178,039; 4,121,662; 4,207,179; and 4,289,578. Typifying the many methods of in situ retorting are those found in U.S. Pat. Nos. 1,913,395; 1,191,636; 2,418,051; 3,001,776; 3,586,377; 3,434,757; 3,661,423; 3,951,456; 3,980,339; 3,994,343; 4,007,963; 4,017,119; 4,105,251; 4,120,355; 4,126,180; 4,133,380; 4,149,752; 4,153,300; 4,158,467; 4,117,886; 4,185,871; 4,194,788; 4,199,026; 4,210,867; 4,210,868; 4,231,617; 4,243,100; 4,263,969; 4,263,970; 4,265,486; 4,266,608; 4,271,904; 4,315,656; 4,323,120; 4,323,121; 4,328,863; 4,343,360; 4,343,361; 4,353,418; 4,378,949; 4,425,967; and 4,436,344. These prior art processes have met with varying degrees of success.

It is, therefore, desirable to provide an improved in situ oil shale retort and process which overcome most, if not all, of the above problems.

SUMMARY OF THE INVENTION

An improved in situ process is provided to retort oil shale which increases product yield and quality. In the novel process, flow of the flame front-supporting feed gas to the underground retort is intermittently stopped with a water purge to alternately extinguish and ignite the flame front in the underground retort while continuously retorting raw oil shale in the retort. This alternate extinguishment and ignition of the flame front is referred to as "pulsed combustion." The water purge can be purified water, condensed steam, or retort water recycled from an underground or aboveground retort. Retort water typically contains oil shale particulates, shale oil, ammonia, and organic carbon. The flame front-supporting feed gas as can be air, or air diluted with steam, water, and/or recycled retort off gases.

Pulsed combustion promotes uniformity of the flame front and minimizes fingering and projections of excessively high temperature zones in the rubblized bed of shale. When the combustion-sustaining feed gas is shut off, combustion stops and burning of product oil is quenched and the area in which the flame front was present remains stationary during shut off to distribute heat downward in the bed. Upon reignition, a generally horizontal flame front is established which advances in the general direction of flow of the feed gas. Intermittent injection of the feed gas lowers the temperature of the flame front, minimizes carbonate decomposition, coking and thermal cracking of liberated hydrocarbons. The pulse rate and duration of the feed gas control the profile of the flame front.

During purging, heat is dissipated throughout the bed where retorting was incomplete or missed and these regions are retorted to increase product recovery. Thermal irregularities in the bed equilibrate between pulses to lower the maximum temperature in the retort.

During periods of noncombustion, sensible heat from the retorted and combusted shale advances downward through the raw colder shale to heat and continue retorting the bed. Continuous retorting between pulses, advances the leading edge (front) of the retorting zone and thickens the layer of retorted shale containing unburned, residual carbon to enlarge the separation between the combustion and retorting zones when the flame front is reignited in response to injection of the next pulse of feed gas. Greater separation between the combustion and retorting zones decreases flame front breakthrough, oil fires and gas explosions.

During shutoff of the flame front-supporting feed gas, the liberated shale oil has more time to flow downward and liquefy on the colder raw shale. Drainage and evacuation of oil during noncombustion moves the effluent oil farther away from the combustion zone upon reignition to provide an additional margin of safety which diminishes the chances of oil fires. Additional benefits of pulsed combustion include the ability to more precisely detect the location and configuration of the flame front and retorting zone by monitoring the change of off gas composition.

During retorting, oil shale retort water is formed from the thermal decomposition of kerogen which is referred to as "water of formation." Oil shale retort water can also be derived from in situ steam injection (process water), aquifers or natural underground streams in in situ retorts (aquifer water), and in situ shale combustion (water of combustion). Raw retort oil shale water, however, if left untreated, is generally unsuitable for safe discharge into lakes and rivers or for use in downstream shale oil processes, because it contains a variety of suspended and dissolved pollutants, impurities and contaminants, such as raw, retorted and spent oil shale particulates, shale oil, grease, ammonia, phenols, sulfur, cyanide, lead, mercury and arsenic. Oil shale water is much more difficult to process and purify than waste water from natural petroleum refineries, chemical plants and sewage treatment plants, because oil shale water generally contains a much greater concentration of suspended and dissolved pollutants which are only partially biodegradable. For example, untreated retort water contains over 10 times the amount of total organic carbon and chemical oxygen demand, over 5 times the amount of phenol and over 200 times the amount of ammonia as waste water from natural petroleum refineries.

In accordance with one aspect of this invention, raw retort oil shale water can be recycled and injected into the retort for use as part or all of the purge water and/or part of the feed gas thereby avoiding expensive, cumbersome, and complicated retort water purification processes and treatments.

As used in this application, the terms "oil shale water," "shale water," and "retort water" mean water which has been emitted during retorting of raw oil shale.

The term "shale oil" means oil which has been obtained from retorting raw oil shale.

The term "retorted oil shale" means raw oil shale which has been retorted to liberate shale oil, light hydrocarbon gases and retort water, leaving an inorganic material containing residual carbon.

The terms "spent oil shale" and "combusted oil shale" as used herein mean retorted oil shale from which most of the residual carbon has been removed by combustion.

The term "oil shale particulates" as used herein includes particulates of raw, retorted and combusted oil shale ranging in size from less than 1 micron to 1,000 microns.

The terms "normally liquid," "normally gaseous," "condensible," "condensed," and "noncondensible" as used throughout this application are relative to the condition of the subject material at a temperature of 77° F. (25° C.) at atmospheric pressure.

A more detailed explanation of the invention is provided in the following description and appended claims taken in conjunction with the accompanying drawings.

BRIEF DESCRIPTION OF THE DRAWING

The Figure is a schematic cross-sectional view of an in situ retort for carrying out a process in accordance with principles of the present invention.

DETAILED DESCRIPTION OF THE PREFERRED EMBODIMENT

Referring now to the drawing, an underground, modified in situ, oil shale retort 10 located in a subterranean formation 12 of oil shale is covered with an overburden 14. Retort 10 is elongated, upright, and generally box-shaped, with a top or dome-shaped roof 16.

Retort 10 is filled with an irregularly packed, fluid permeable, rubblized mass or bed 18 of different sized oil shale fragments including large oil shale boulders 20 and minute oil shale particles or fines 22. Irregular, horizontal and vertical channels 24 extend throughout the bed and along the walls 26 of retort 10.

The rubblized mass is formed by first mining an access tunnel or drift 28 extending horizontally into the bottom of retort 10 and removing from 2% to 40% and preferably from 15% to 25% by volume of the oil shale from a central region of the retort to form a cavity or void space. The removed oil shale is conveyed to the surface and retorted in an above ground retort. The mass of oil shale surrounding the cavity is then fragmented and expanded by detonation of explosives to form the rubblized mass 18.

Conduits or pipes 30–35 extend from above ground through overburden 14 into the top 16 of retort 10. These conduits include ignition fuel lines 30 and 31, feed lines 32 and 33, and purge lines 34 and 35. The extent and rate of gas flow through the fuel, feed, and purge lines are regulated and controlled by control valves 36, 38, and 40, respectively. Burners 42 are located in proximity to the top of the bed 18.

In order to commence retorting or pyrolyzing of the rubblized mass 18 of oil shale, a liquid or gaseous fuel, preferably a combustible ignition gas or fuel gas, such as recycled off gases or natural gas, is fed into retort 10 through fuel lines 30 and 31, and an oxygen-containing, flame front-supporting, feed gas or fluid, such as air, is fed into retort 10 through feed lines 32 and 33. Burners 42 are then ignited to establish a flame front 44 horizontally across the bed 18. If economically feasible or otherwise desirable, the rubblized mass 18 of oil shale can be preheated to a temperature slightly below the retorting temperature with an inert preheating gas, such as steam, nitrogen, or retort off gases, before introduction of feed fluid and ignition of the flame front. After ignition, fuel valve 36 is closed to shut off inflow of fuel gas. Once the flame front is established, residual carbon contained in the oil shale usually provides an adequate source of fuel to maintain the flame front as long as the oxygen-containing feed gas is supplied to the flame front. Fuel gas or shale oil can be fed into the retort through the fuel line to augment the feed gas for leaner grades and seams of oil shale.

The oxygen-containing feed sustains and drives the flame front 44 downwardly through the bed 18 of oil shale. The feed gas or fluid can be air, or air enriched with oxygen, or air diluted with a diluent. The diluent can be steam, recycled retort off gases, purified (treated) water, condensed steam, or raw oil shale retort water containing oil shale particulates, shale oil, ammonia, and organic carbon, or combinations thereof, as long as the feed gas has from 5% to less than 90% and preferably from 10% to 30% and most preferably a maximum of 20% by volume molecular oxygen. The oxygen content of the feed gas can be varied throughout the process.

Flame front 44 emits combustion off gases and generates heat which move downwardly ahead of flame front 44 and heats the raw, unretorted oil shale in retorting zone 46 to a retorting temperature from 800° F. to 1200° F. to retort and pyrolyze the oil shale in retorting zone 46. During retorting, oil shale retort water and hydrocarbons are liberated from the raw oil shale. The hydrocarbons are liberated as a gas, vapor, mist or liquid droplets and most likely a mixture thereof. The liberated hydrocarbons include light gases, such as methane, ethane, ethene, propane, and propene, and normally liquid shale oil, which flow downwardly by gravity, condense and liquefy upon the cooler, unretorted raw shale below the retorting zone, forming condensates which percolate downwardly through the retort into access tunnel 28.

Retort off gases emitted during retorting include various amounts of hydrogen, carbon monoxide, carbon dioxide, ammonia, hydrogen sulfide, carbonyl sulfide, oxides of sulfur and nitrogen, water vapors, and low molecular weight hydrocarbons. The composition of the off gas is dependent on the composition of the feed.

Oil shale retort water is laden with suspended and dissolved impurities including shale oil and particulates of raw, retorted and/or spent oil shale ranging in size from less than 1 micron to 1,000 microns as well as a variety of other impurities as explained below. The amount and proportion of the shale oil, oil shale particulates and other impurities depend upon the richness and composition of the oil shale being retorted, the composition of the feed gas and retorting conditions. One sample of retort water from a modified in situ retort had a pH of 8.9 to 9.1 and an alkalinity of 12,000 mg/l, and contained 1,800 mg/l total organic carbon, 7,000 mg/l chemical oxygen demand, 15,000 mg/l total solids, 1,600 mg/l ammonia, 6,000 mg/l sodium, 7 mg/l magnesium and 5 mg/l calcium.

Three other test samples of oil shale retort water from a modified,in situ retort has the following composition:

| | Test 1 | Test 2 | Test 3 |
|---|---|---|---|
| COD, mg/l | 11174 | 13862 | 10140 |
| Phenols, mg/l | 29 | 30 | 30 |
| Total dissolved solids, mg/l | 3159 | 2151 | 1099 |
| Total suspended solids, mg/l | 718 | 435 | 10.8 |
| Organic C, ppm | 6660 | 5640 | 4220 |
| Inorganic C, ppm | 1520 | 1600 | 4120 |
| $NH_3$, ppm | 1150 | 6000 | 690 |
| Cu, ppm | <0.05 | <0.05 | <0.05 |

-continued

| | Test 1 | Test 2 | Test 3 |
|---|---|---|---|
| F—, ppm | 2 | 3 | 1 |
| N, ppm | 5200 | 4700 | 6970 |
| Ni, ppm | 0.38 | 0.53 | 0.30 |
| P, ppm | 3 | <1 | 852 |
| S, % | 0.05 | 0.05 | 0.04 |
| Zn, ppm | 0.05 | 0.08 | 0.08 |
| CN—, ppm | <.01 | <.01 | 0.41 |
| Ag, ppm | <0.05 | <0.05 | <0.05 |
| As, ppm | 1.06 | 0.47 | 0.5 |

Another test sample of oil shale retort water from a modified in situ retort had the following composition:

| | |
|---|---|
| $HCO_3$ | 668 mg/l |
| SCOD | 1249 mg/l |
| TOTAL ALKALINITY | 1164 mg/l |
| N (TOTAL) | 540 mg/l |
| $NH_3$ | 392 mg/l |
| $NO_3$ | .41 mg/l |
| F | 1.29 mg/l |
| S | 53.0 mg/l |
| TOC | 281 mg/l |
| PHENOL | 14.2 mg/l |
| Shale oil and grease | 106 mg/l |
| As | .133 mg/l |
| B | .23 mg/l |
| $SO_4$ | 1916 mg/l |
| $S_2O_3$ | 426 mg/l |
| SCN | 0.17 mg/l |
| CN | <.05 mg/l |
| pH | 8.7 |
| ORGANIC-N | 80.8 mg/l |
| TRACE ELEMENTS | |
| Ba | <.1 mg/l |
| Cd | <.01 mg/l |
| Cr | <.01 mg/l |
| Cu | <.01 mg/l |
| Pb | <.05 mg/l |
| Hg | <.0003 mg/l |
| Mo | 0.9 mg/l |
| Sc | <.05 mg/l |
| Ag | <.01 mg/l |
| Zn | <.01 mg/l |

The effluent product stream of condensate (liquid shale oil and oil shale retort water) and off gases, flow downwardly to the sloped bottom 48 of retort 10 and then into a collection basin and separator 50, also referred to as a "sump" in the bottom of access tunnel 28. Concrete wall 52 prevents leakage of off gas into the mine. The liquid shale oil, water and gases are separated in collection basin 50 by gravity and can be pumped to the surface by pumps 54, 56, and 58, respectively, through inlet and return lines 60, 62, 64, 66, 68 and 70, respectively. Raw (untreated) retort off gases can be recycled as part of the feed, either directly or after light gases and oil vapors contained therein have been stripped away in a quench tower or stripping vessel.

During the process, retorting zone 46 moves downwardly leaving a layer or band 72 of retorted shale with residual carbon. Retorted shale layer 72 above retorting zone 46 defines a retorted shale zone which is located between retorting zone 46 and the flame front 44 of combustion zone 74. Residual carbon in the retorted shale is combusted in combustion zone 74 leaving spent, combusted shale in a spent shale zone 76.

In order to enhance a more uniform flame front 44 across retort 10, the feed gas or fluid in feed line 32 is fed into retort 10 in pulses by intermittently stopping the influx of the feed fluid with control valve 38 to alternately quench and reignite flame front 44 for selected intervals of time. A purging fluid, also referred to as a purge fluid or purge, is injected or sprayed downwardly into combustion zone 74 through purge line 35 between pulses of feed. The purge fluid extinguishes flame front 44 and accelerates transfer of sensible heat from combustion zone 74 to retorting zone 46.

In the preferred process, most or all of the purge fluid is raw (untreated) retort shale water containing oil shale particulates, shale oil, organic carbon, and ammonia, which has been fed (recycled) to purge line 35 by retort water lines 66, 78, and 80 via retort water valves 82 and 84. This avoids the enormous expense of purifying and treating the contaminated retort water to environmentally acceptable levels and thereby enhances retorting efficiency and economy. Excess retort water can be discharged for purification, treatment, and/or further processing, through water discharge line 86 via two-way valve 84, after closing valves 82 and 88. The purge fluid can also contain or consist entirely of purified (treated) water or condensed steam fed into purge line 34. Alternatively, retort water from an aboveground retort can be fed into purge line 34.

Raw (untreated) retort water containing oil shale particulates, oil shale, organic carbon and ammonia can be fed (recycled) to the feed line 33 by lines 66, 78, 90, and 92, upon opening water feed valves 86 and 88, for use as part of the feed for even greater retorting economy and efficiency. Retort water from an aboveground retort can also be fed into feed line 32 for use as part of the feed.

During purging, i.e., between pulses of feed, retorting of oil shale continues. The purge fluid enhances the rate of downward advancement of retorting zone 46 to widen the gap and separation between the leading edge or front of retorting zone 46 and the combustion zone 74. Purging also thickens the retorted shale layer 72 and enlarges the separation between retorting zone 46 and combustion zone 74. The enlarged separation minimizes losses from oil burning upon reignition which occurs when the next pulse of feed is injected. The combustion zone 72 can be cooled to a temperature as low as 650° F. by the water purge and still have successful ignition with the next pulse of feed gas.

The injection pressures of the feed and fuel gases are from one atmosphere to 5 atmospheres, and most preferably 2 atmospheres. The flow rates of the feed and fuel gases are a maximum of 10 SCFM/ft$^2$, preferably from 0.01 SCFM/ft$^2$ to 6 SCFM/ft$^2$, and most preferably from 1.5 SCFM/ft$^2$ to 3 SCFM/ft$^2$.

The injection pressure of the water purge is from about 0.5 to about 5 atmospheres, and most preferably a maximum of 2 atmospheres. The flow rate of the water purge is from about 0.1 to 3.75 gal/hr/ft$^2$ (30 lbs/hr/ft$^2$) and most preferably a maximum of 0.275 gal/hr/ft$^2$ (2.2 lbs/hr/ft$^2$).

The duration of each pulse of feed gas and purge is from 15 minutes to 1 month, preferably from 1 hour to 24 hours and most preferably from 4 hours to 12 hours. The time ratio of purge to feed gas is from 1:10 to 10:1 and preferably from 1:5 to 1:1.

Off gases produced during purging with the water purge have a substantially greater concentration of hydrogen than the off gases produced during combustion with the feed fluid. The hydrogen-rich off gases produced during purging can be fed to a $C0_2$ scrubber 94 by off gas lines 70 and 96 via two-way gas valve 98, where the off gases are scrubbed of carbon dioxide. Carbon dioxide is removed from the scrubber through $CO_2$ line 100 and recycled for use as part of the purge gas or vented to the atmosphere. The scrubbed hydrogen-rich off gases, which contain at least 70%, preferably at least 80%, and most preferably at least 95%, by weight hydrogen, are fed to one or more upgrading or upgrader reactors 102, such as hydrotreaters, hydrocrackers, or catalytic crackers, through scrubbed gas line 104 for use as an upgrading gas in upgrading shale oil produced in the retorts.

Fresh, makeup catalyst is fed to the reactor(s) through catalyst line 106. Shale oil produced in the retorts are fed to the reactor(s) through shale oil line 62. The reactor(s) can be a fluid bed reactor, ebullated bed reactor, or fixed bed reactor.

In the reactor(s), the shale oil is contacted, mixed, and circulated with the upgrading gas in the presence of the catalyst under upgrading conditions to substantially remove nitrogen, oxygen, sulfur, and trace metals from the shale oil in order to produce an upgraded, more marketable, shale oil or syncrude. Upgraded shale oil is removed from the reactor(s) through syncrude line 108. Spent catalyst is removed from the reactor(s) through spent catalyst line 110. Reaction off gases are removed from the reactor(s) through line 112. The reaction off gases can be recycled as part of the fuel gas or feed gas, or can be used for other purposes.

The catalyst has at least one hydrogenating component, such as cobalt, molybdenum, nickel, or phosphorus, or combinations thereof, on a suitable support, such as alumina, silica, zeolites, and/or molecular sieves having a sufficient pore size to trap the trace metals from the shale oil. Other upgrading catalysts can be used.

Typical upgrading conditions in the reactor(s) are: total pressure from 500 psia to 6000 psia, preferably from 1200 psia to 3000 psia; hydrogen partial pressure from 500 psia to 3000 psia, preferably from 1000 psia to 2000 psia; upgrading gas flow rate (off gas feed rate) from 2500 SCFB to 10,000 SCFB, and LHSV (liquid hourly space velocity) from 0.2 to 4, and preferably no greater than 2 volumes of oil per hour per volume of catalyst. Hydrotreating temperatures range from 700° F. to 830° F. Hydrocracking temperatures range from 650° F. to 820° F.

The hydrogen lean retort off gases produced during the combustion mode in the underground retort are passed through gas line 114 via valve 98 can be recycled into lines 30 and/or 32 as part of the feed and/or fuel gas. Alternatively, the hydrogen lean retort off gases can be fed upstream for further processing or flared for heating value.

While vertical retorts are preferred, horizontal and other shaped underground retorts can be used. Furthermore, while it is preferred to commence pulsed combustion at the top of the bed of shale in the retort, in some circumstances it may be desirable to commence pulsing at other sections of the retort.

Among the many advantages of the above process are:

1. Better process efficiency.
2. Greater retorting economy.
3. Less purification and treatment of retort water.
4. Improved product yield and recovery.
5. Uniformity of flame front.
6. Fewer oil fires.
7. Less loss of product oil.
8. Decreased carbonate decomposition and thermal cracking of the effluent shale oil.
9. Reduced need for supplemental fuel gas, feed gas, and purge gas.
10. Lower upgrading costs.

Although an embodiment of this invention has been shown and described, it is to be understood that various modifications and substitutions, as well as rearrangements of parts, components, and/or process steps, can be made by those skilled in the art without departing from the novel spirit and scope of this invention.

What is claimed is:

1. A process for retorting oil shale, comprising the steps of:

heating a portion of a rubblized mass of oil shale in a retorting zone of an underground retort to a retorting temperature to liberate shale oil and retort water from said oil shale leaving retorted shale containing residual carbon;

combusting said residual carbon in said oil shale in a combustion zone behind said retorting zone in said underground retort with a flame front fed by an oxgen-containing, combustion-sustaining, feed gas to provide a substantial portion of said heating, said flame front advancing generally in the direction of flow of said feed gas;

injecting a purge liquid comprising retort water in the absence of said oxygen-containing, combustion-sustaining, feed gas into said underground retort to quench said flame front while substantially stopping and blocking the flow of said oxygen-containing, combustion-sustaining, feed gas into said retort while simultaneously continuing to libcrate shale oil and retort water in said underground retort;

said retort water liberated from said retort and injected into said underground retort as said purge liquid, comprising raw, retorted and spent oil shale particulates ranging in size from less than 1 micron to 1000 microns, water, shale oil, phenols, organic carbon, ammonia, sodium, iron, sulfur, magnesium, calcium, nitrogen, nickel, copper, phosphorus, zinc, and arsenic;

reigniting said flame front with said oxygen-containing, combustion-sustaining, feed gas by feeding said oxgen-containing feed gas into said retort in the absence of said retort water purge liquid while simultaneoulsy substantially stopping and preventing the flow of said retort water purge liquid into said retort; and withdrawing said liberated shale oil and retort water from said underground retort.

2. A process for retorting oil shale, comprising the steps of:

(a) heating a portion of a rubblized mass of oil shale in a retorting zone of an underground retort to a retorting temperature from 800° F. to 1200° F. to liberate shale oil and retort water from said oil shale leaving retorted shale containing carbon residue;

(b) combusting said carbon residue in said retorted oil shale in a combustion zone above said retorting zone in said underground retort with a flame front;

(c) pulsing a combustion-supporting feed fluid containing from 5% to less than 90% by volume molecular oxygen into said combustion zone by intermittently feeding said combustion-supporting feed fluid into said combustion zone to repetitively ignite and extinguish said flame front for preselected periods of time;

(d) injecting a flame-front extinguishing purging fluid comprising particulate-laden retort water containing particulates of oil shale, dissolved solids and suspended solids, including organic and inorganic carbon, nitrogen, ammonia, and shale oil, into said retort between said intermittent feeding and pulses of said feed gas to extinguish said flame front without cooling said retorting zone below said retorting temperature, while simultaneously continuing to liberate shale oil and retort water in said underground retort, while simultaneously substantially stopping and preventing said combustion-supporting feed gas from being fed into said retort;

(e) withdrawing said liberated shale oil and retort water from said retort; and (f) recycling said withdrawn retort water to said retort for use as said purging fluid in step (d) without purifying said particulate-laden retort water.

3. A process for retorting oil shale, comprising the steps of:

(a) forming a generally upright modified in situ underground oil shale retort in a subterranean formation of raw oil shale by removing from 2% to 40% by volume of said oil shale from said formation leaving a cavity, transporting siad removed shale to a location above ground for surface retorting, and explosively rubblizing a mass of said oil shale substantially surrounding said cavity to form said underground retort;

(b) igniting a flame front generally across said retort;

(c) pyrolyzing a portion of said rubblized raw oil shale in a retorting zone of said underground retort to liberate shale oil, off gases, and raw retort water from said raw oil shale leaving retorte shale containing residual carbon, said raw retort water containing oil shale particulates, shale oil, ammonia, organic carbon, iron, phenols, ammonia, sodium, sulfur, magnesium, calcium, nitrogen, nickel, copper, zinc, and phosphorus;

(d) advancing said retorting zone generally downwardly in said underground retort;

(e) combusting residual carbon on said retorted shale in a combustion zone above said retorting zone in said underground retort with a flame front supported by a flame front-supporting feed fluid comprising air;

(f) alternately injecting said flame front-supporting feed fluid comprising air and a flame front-extinguishing purging liquid comprising said raw retort water containing oil shale particulates, shale oil, ammonia, organic carbon, iron, phenols, ammonia, sodium, sulfur, magnesium, calcium, nitrogen, nickel, copper, zinc, and phosphorus, into said combustion zone while continuing step (d), said flame front-supporting feed fluid supporting, igniting and propelling said flame front generally downwardly in said underground retort, said flame front-extinguishing purging liquid extinguishing said flame front and accelerating transfer of sensible heat from said combustion zone to said retorting zone;

(g) substantially preventing said air from being injected into said retort while said retort water purging liquid is injected into said retort to extinguish said flame front; and (h) withdrawing said liberated shale oil, off gases, and raw retort water from said underground retort.

4. A process for retorting oil shale in accordance with claim 3 wherein 15% to 25% of said raw oil shale is removed from said subterranean formation, and said combustion zone is cooled with said purging liquid to a temperature greater than 650° F. but less than 800° F. before reignition.

5. A process for retorting oil shale in accordance with claim 4 wherein at least some of said withdrawn retort water in step (g) is injected into said underground retort as part of said flame front-supporting feed fluid in step (f).

6. A process for retorting oil shale in accordance with claim 4 wherein purge mode off gases are liberated during injection with said retort water, combustion mode off gases are liberated during combustion of said residual carbon with said flame front-supporting feed fluid, and said purge mode off gases have a substantially greater concentration of hydrogen than said combustion mode off gases.

* * * * *

UNITED STATES PATENT OFFICE
CERTIFICATE OF CORRECTION

Patent No. 4,637,464 Dated January 20, 1987

Inventor(s) JOHN M. FORGAC and GEORGE R. HOEKSTRA

It is certified that error appears in the above-identified patent and that said Letters Patent are hereby corrected as shown below:

| Column | Line | |
|---|---|---|
| 9 | 47 | "98 can" should be -- 98 and can -- |
| 10 | 31 | "libcrate" should be -- liberate -- |
| 11 | 26 | "siad" should be -- said -- |
| 11 | 35 | "retorte" should be -- retorted -- |

Signed and Sealed this

Twenty-ninth Day of December, 1987

*Attest:*

DONALD J. QUIGG

*Attesting Officer* *Commissioner of Patents and Trademarks*